US007685982B2

(12) United States Patent
Inaba et al.

(10) Patent No.: US 7,685,982 B2
(45) Date of Patent: Mar. 30, 2010

(54) OUTBOARD ENGINE UNIT

(75) Inventors: Takeshi Inaba, Saitama (JP); Masanori Tsubouchi, Saitama (JP); Nobuo Suzuki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 28 days.

(21) Appl. No.: 11/801,593

(22) Filed: May 10, 2007

(65) Prior Publication Data

US 2007/0277760 A1 Dec. 6, 2007

(30) Foreign Application Priority Data

May 31, 2006 (JP) ..... 2006-152345

(51) Int. Cl.
*F01L 1/02* (2006.01)

(52) U.S. Cl. ..... 123/90.31; 123/90.33

(58) Field of Classification Search ..... 123/90.31, 123/90.33, 90.34, 196 M
See application file for complete search history.

(56) References Cited

U.S. PATENT DOCUMENTS

| | | | | |
|---|---|---|---|---|
| 5,186,129 | A * | 2/1993 | Magnan et al. | 123/90.34 |
| 2001/0049978 | A1 * | 12/2001 | Iwata et al. | 74/606 R |
| 2005/0009420 | A1 * | 1/2005 | Yoshida et al. | 440/88 L |

FOREIGN PATENT DOCUMENTS

| | | |
|---|---|---|
| JP | 2001-303919 | 10/2001 |
| JP | 2004-346891 | 12/2004 |

* cited by examiner

*Primary Examiner*—Zelalem Eshete
(74) *Attorney, Agent, or Firm*—Carrier, Blackman & Associates P.C.; Joseph P. Carrier; William D. Blackman

(57) ABSTRACT

An outboard engine unit includes a single lubricating oil supply tube for supplying lubricating oil to a valve-operating chain. The valve-operating chain is suspended across a drive sprocket provided to a crankshaft and a driven sprocket provided to a camshaft. A supply tube is connected to a main gallery that is linked to a main oil channel positioned in an area adjacent to the crankshaft.

19 Claims, 7 Drawing Sheets

OUTBOARD ENGINE UNIT

FIELD OF THE INVENTION

The present invention relates to an outboard engine unit having improved means for supplying lubrication to a valve-operating chain in the engine of an outboard engine unit in which the chain is used as a means to drive a valve-operating mechanism.

BACKGROUND OF THE INVENTION

A lubricating structure of a valve-operating chain of a vertical engine mounted in an outboard engine unit is disclosed in Japanese Patent Laid-Open Publication No. 2004-346891 (JP 2004-346891 A).

A lubrication structure of a timing chain of an engine having a variable valve timing mechanism is disclosed in Japanese Patent Laid-Open Publication No. 2001-303919 (JP 2001-303919 A).

The lubrication structure disclosed in JP 2004-346891 A is structured to allow oil to flow down along ribs from the ceiling surface of a chain cover and to bring oil into contact with a timing chain. A camshaft-side oil jet is disposed in the oil supply channel.

However, considering the length of the main body portion of the oil jet, the oil supply channel must be disposed near upper cylinders, and a configuration is needed that has a higher degree of freedom of design. The jet nozzle sprays oil toward the meshing area of the chain. Therefore, a portion of the dispersed oil is captured and guided by the upper ribs to lubricate the chain again, and the rest of the oil is recovered. Efficiency is improved if the ratio of oil supplied for lubrication is increased.

The lubrication structure disclosed in JP 2001-303919 A is a structure, provided in an ordinary engine having variable valves rather than in a vertical engine, in which an oil channel is disposed in a chain cover provided to the side of the engine and an oil jet is disposed in the oil channel. Therefore, the structure of the chain cover is made more complicated, manufacturing steps are increased, added labor is required, and other disadvantageous factors are incurred.

In view of the above, there is a need to simplify the lubrication structure of the valve-operating chain used in the main gallery, which is the main oil pathway disposed in an engine.

SUMMARY OF THE INVENTION

According to the present invention, there is provided an outboard engine unit comprising a four-stroke vertical engine comprised of a plurality of horizontal cylinders and a vertical crankshaft; a valve-operating chain disposed above the engine and trained around a drive sprocket, provided on the crankshaft, and a driven sprocket, provided on a camshaft of the engine; and a supply tube for supplying lubricating oil to the valve-operating chain, wherein the supply tube is connected to a main gallery that is linked to a main oil channel positioned in an area adjacent to the crankshaft.

Therefore, the lubricating oil supply channel is composed solely of a main gallery positioned on the crankshaft side and a supply tube connected to the main gallery, and the lubrication structure of the valve-operating chain can be simplified, manufacturing can be facilitated, and costs can be reduced.

Preferably, a valve-operating chain is housed in a sealed chain compartment and the supply tube has a discharge port oriented in the direction above the chain compartment. Therefore, the moving valve-operating chain can be lubricated with good efficiency. Since the lubricating oil is recovered in the chain compartment, this configuration contributes to the effective use of lubricating oil.

Desirably, the supply tube has discharge ports disposed at the two ends of the supply tube and directed toward the mesh start areas between the valve-operating chain and the drive sprocket and driven sprocket of the chain. Thus, lubricating oil can be efficiently supplied to the drive sprocket side and the driven sprocket side.

BRIEF DESCRIPTION OF THE DRAWINGS

A preferred embodiment of the present invention will be described in detail hereinafter with reference to the accompanying drawings, wherein.

DESCRIPTION OF THE PREFERRED EMBODIMENT

Figure 1:
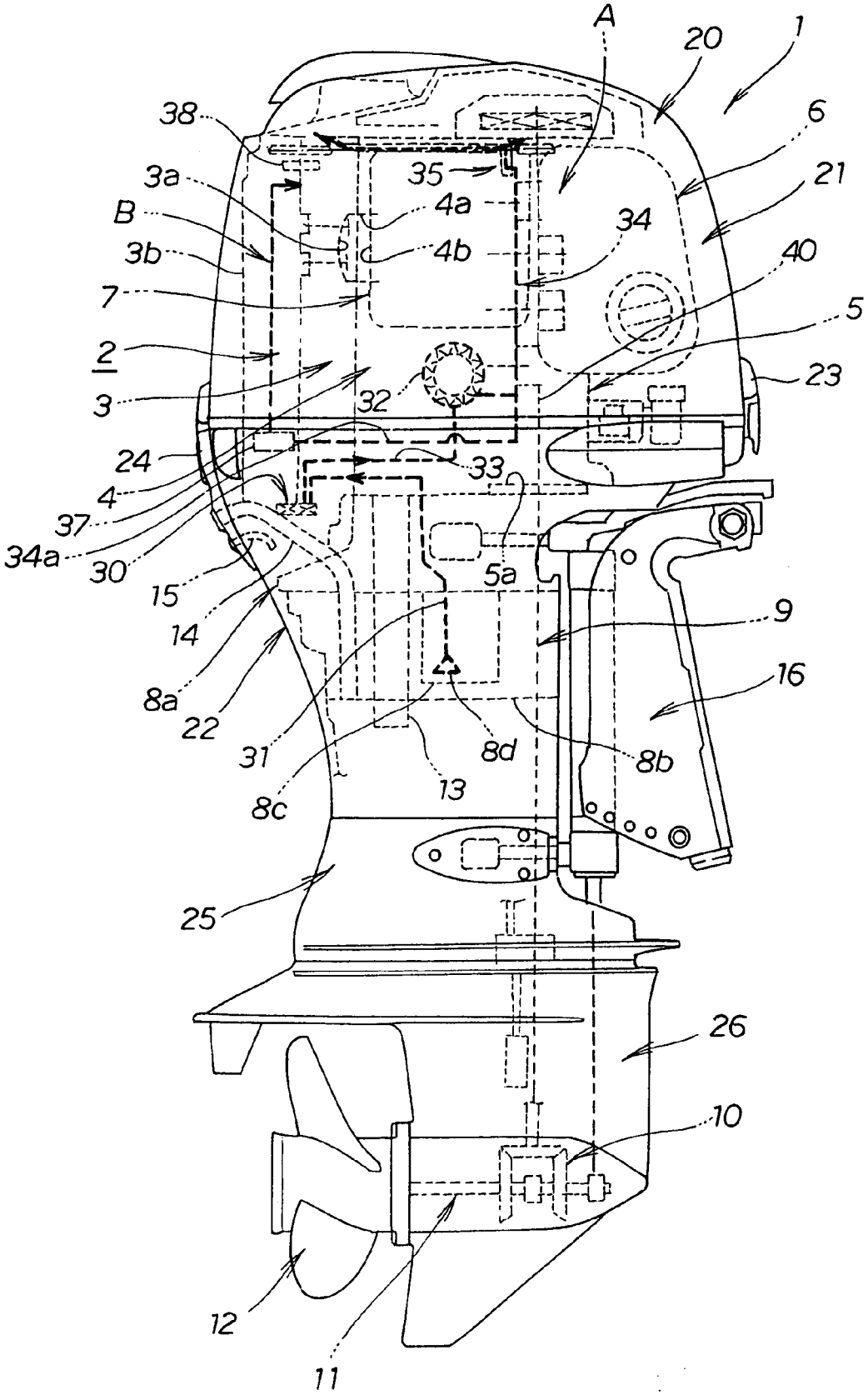
FIG. 1 is a side elevational view of the outboard engine unit according to the present invention.

As shown in FIG. 1, an outboard engine unit 1 has an engine 2 covered by an engine cover 20.

The engine 2 is a multi-cylinder four-stroke engine provided with substantially horizontally (hereinafter referred to as transverse) moving pistons and a vertically disposed crankshaft. The engine 2 is provided with a cylinder block 4, a cylinder head 3 disposed in the rear portion of the cylinder block 4, and a crankcase 5 disposed in the front portion of the cylinder block 4. The cylinder head 3 has a plurality of combustion chambers 3*a* and is covered by a cylinder head cover 3*b*. The cylinder block 4 has a plurality of cylinders 4*a* and a plurality of pistons 4*b* corresponding to the cylinders 4*a*. The crankcase 5 houses a vertical crankshaft 40.

An intake silencer 6 is disposed from the front portion of the right side of the crankcase 5 across the forward portion. The intake silencer 6 introduces air (fresh air) from an engine intake port.

An electric box (electric component) 7 is disposed on the right-side surface of the cylinder block 4. The electric box 7 accommodates electronic control devices and other electric component boards that control the ignition and fuel injection devices of the engine.

The engine 2 is supported by a mounting case 8*a*. An oil case 8*b* that houses an oil pan 8*c* is joined to the lower surface of the mounting case 8*a*.

The engine 2 is covered by an engine cover 20. The engine cover 20 is composed of an upper cover 21 that covers the upper portion of the engine, and a lower cover 22 that covers the lower portion of the engine 2. The engine compartment A that houses the engine 2 is partitioned by the upper and lower covers 21 and 22. The upper cover 21 can be opened with respect to the lower cover by operating lock mechanisms 23 and 24 disposed on the front and rear of the outboard engine unit 1 so that the engine 2 can be serviced and repaired.

A vertical crankshaft 40 is provided with a flywheel 5*a* at the lower end of the crankshaft and is connected to a downwardly suspended drive shaft 9. The drive shaft 9 passes through the inside of an extension case 25 that is disposed below the bottom cover 22, and is connected to a gear transmission mechanism 10 inside a gear case 26 that is mounted on the lower end of the extension case 25.

The gear transmission mechanism 10 transmits the drive force of the drive shaft 9 to a horizontal driven shaft 11. The rear end portion of the horizontal driven shaft 11 protrudes rearward from the gear case 26. A propeller 12 is mounted on the rear end portion of the horizontal driven shaft 11. The propeller 12 is driven by the motive force of the engine 2. The outboard engine unit 1 produces forward or rearward propulsion by switching the direction of the propeller 12 with the aid of a pair of dog clutches.

The outboard engine unit 1 is detachably mounted on the stern by way of a stern bracket 16.

In the diagrams, reference numeral 13 indicates a main exhaust tube. A portion of the exhaust is exhausted rearward from the engine cover 20 by way of a sub-exhaust pipe 14. A water test port 15 discharges a portion of the cooling water in the rearward direction of the lower cover 22 in order to visually confirm whether cooling water is flowing to the engine cooling unit.

Figure 2:
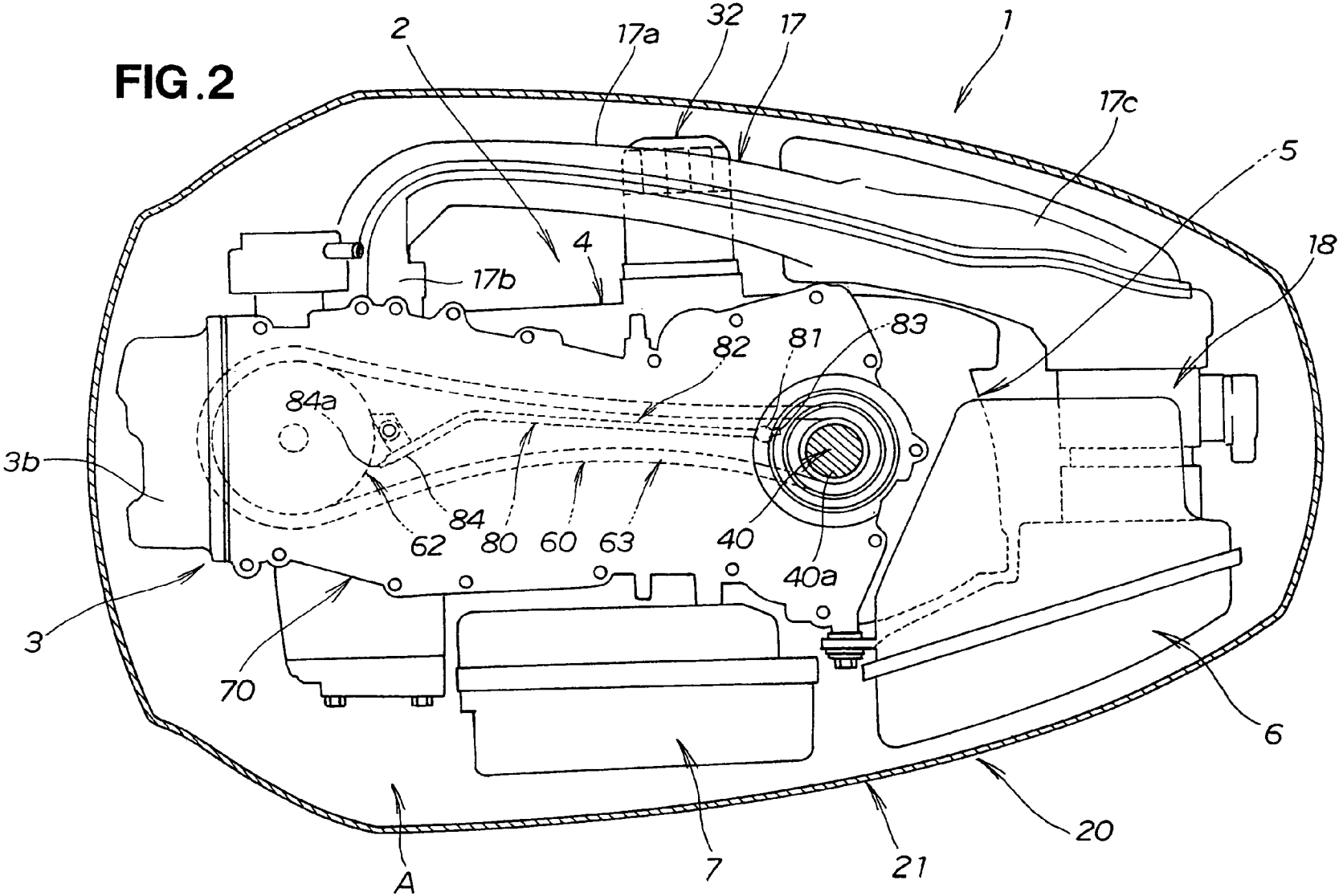
FIG. 2 is a top plan view of an engine in which the upper cover of the outboard engine unit shown in FIG. 1 has been sectioned.

The intake silencer 6 and the electric box 7 are disposed on the right side of the engine 2, as shown in FIG. 2. An intake manifold 17 is disposed on the left side of the engine 2. A plurality of intake tubes 17*a* is disposed above and below the intake manifold 17. Upstream portions 17*b* of the intake tubes 17*a* are connected so as to be in communication with the intake ports of the combustion chambers of the cylinder head 3. The downstream side of the intake tubes 17*a* merges with a surge tank 17*c*. The intake silencers 6 and 17*c* are connected by a throttle valve device 18 and send fuel to the combustion chambers.

The lubricating oil channel will be described next with reference to FIGS. 3 and 4.

The letter B indicating the broken arrow line shown in FIG. 1 shows the oil supply channel of all lubricating oil. The oil supply channel B has an oil channel 31 that is linked to an oil pump 30 from a strainer 8*d* housed in the oil pan 8*c*. The lubricating oil inside the oil pan 8*c* is lifted by an oil pump 30 by way of the oil channel 31. The lifted lubricating oil passes through an oil filter 32 disposed in the side surface of the cylinder block 4 of the engine 2 by way of an oil channel 33 from the oil pump 30, and is pumped to a main oil channel 34. The oil filter 32 is disposed on the left-side surface of the engine block 4, as shown in FIG. 2.

The main oil channel 34 branches immediately after the oil filter 32. A branched oil channel 34*a* is connected from the vicinity of the lower side of the lowermost piston to an oil channel inside a rocker arm shaft by way of a spool valve 37 of a valve operation switching device. The reference numeral 38 shown in FIGS. 1 and 3 indicates an eccentric cam for driving a fuel pump, and supplies lubricating oil to a camshaft 41 and valve rocker arm 42.

The main oil channel 34 is disposed adjacent to the skirt portion of the engine block 4.

The main oil channel 34 is in communication with a main gallery 35 disposed in an opening provided to a bearing 4*c* formed in the cylinder block 4, and supplies pressure oil to the main gallery 35.

A power generator (ACG) 50 is disposed on the upper end portion 40*a* of the crankshaft 40 that protrudes above the cylinder block 4. The power generator 50 is composed of a rotor 51 in which a magnet 51*a* is fastened to the internal peripheral surface, and a power generation coil 52 in which a coil 52*a* is wound about an iron core 52*b*. A recoil starter flange 53 is fastened to the external periphery of the rotor 51. The power generator 50 is covered by a cover 54 in the form of an inverted cap.

The drive sprocket 61 is mounted on the upper end portion 40*a* of the crankshaft 40. The driven sprocket 62 is mounted on the upper end portion 41*a* of the camshaft 41 that protrudes above the cylinder head 3.

The valve-operating chain 63 is suspended across a drive sprocket 61 and a driven sprocket 62. The valve-operating chain 63 is a silent chain and is disposed above the engine 2. A chain drive mechanism 60 is composed of the drive sprocket 61, driven sprocket 62, and valve-operating chain 63.

The drive sprocket 61 is rotatably driven by the crankshaft 40. The driven sprocket 62 is rotatably driven by the drive sprocket 61 by way of the valve-operating chain 63. The camshaft 41 is rotatably driven by the rotations of the driven sprocket 62. The valve rocker arm 42 is slidably driven by the rotations of the camshaft 41, and opens and closes intake valves 43 and exhausts valves 44.

The chain drive mechanism 60 is covered by a chain cover 70. The chain cover 70 is disposed over a surrounding portion 2*b* (FIG. 5*b*) that surrounds the periphery of the chain drive mechanism 60. The surrounding portion 2*b* is formed on the periphery above the engine block 2*a*. The engine block 2*a* is composed of the cylinder head 3, the cylinder block 4, and the crankcase 5. The chain cover 70 forms a housing compartment C for housing the chain drive mechanism 60. The housing compartment C seals and houses the chain drive mechanism 60 by using the upper surface of the engine 2, the surrounding portion 2*b* surrounding the upper surface, and the chain cover 70.

Figure 5:
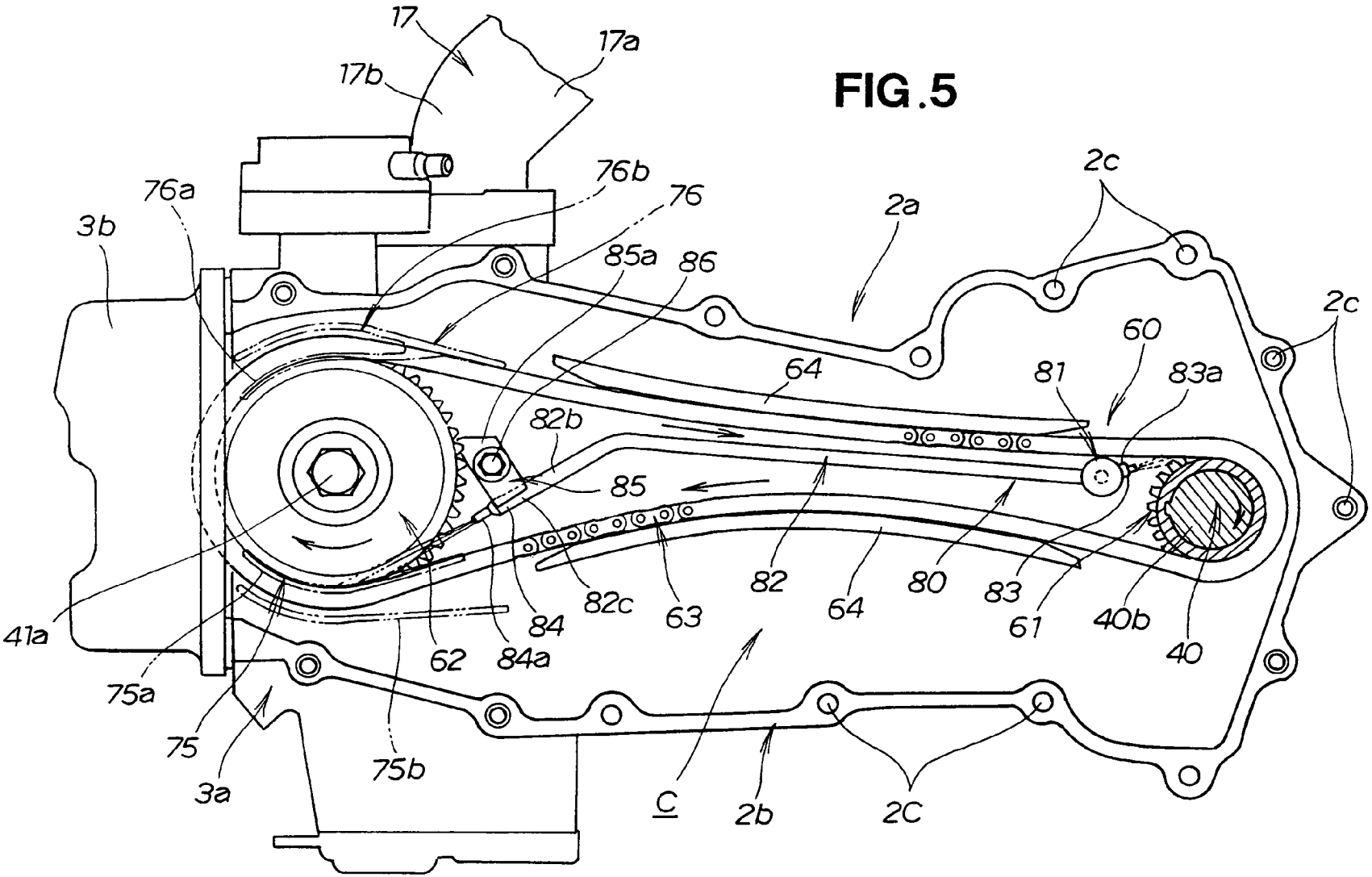
FIG. 5 is a top view showing the engine block and the chain drive mechanism.

Reference numerals 64 and 64 shown in FIG. 5 indicate chain guides disposed to the right and left in an intermediate area of the valve-operating chain 63.

Figure 3:
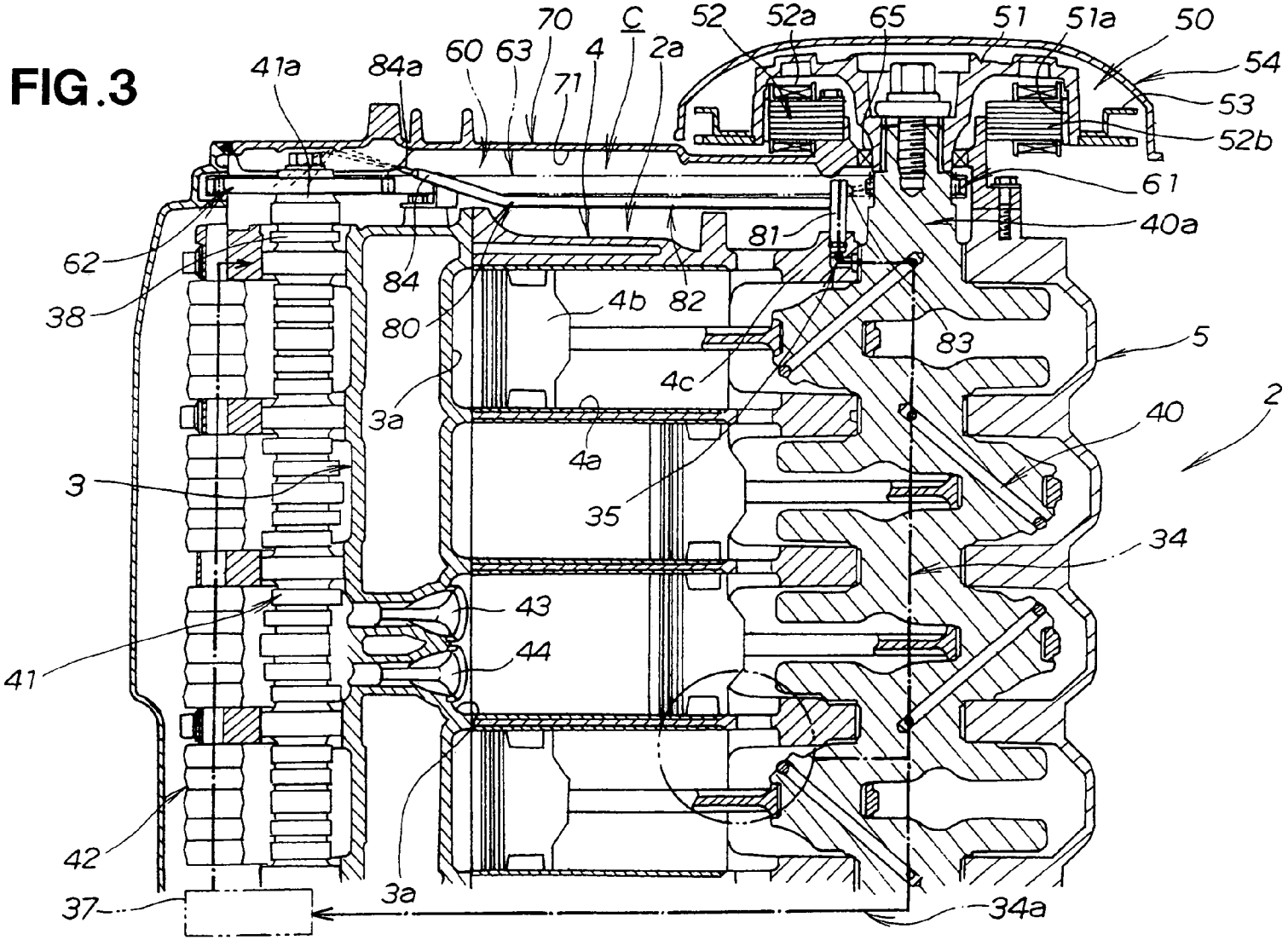
FIG. 3 is an enlarged longitudinal section of the upper portion of the engine 2 shown in FIG. 1.

The upper portion 40*a* of the crankshaft 40 protrudes from a through-hole provided in the front portion of the chain cover 70 by way of an oil seal 65, and is sealed, as shown in FIG. 3.

Figure 4:
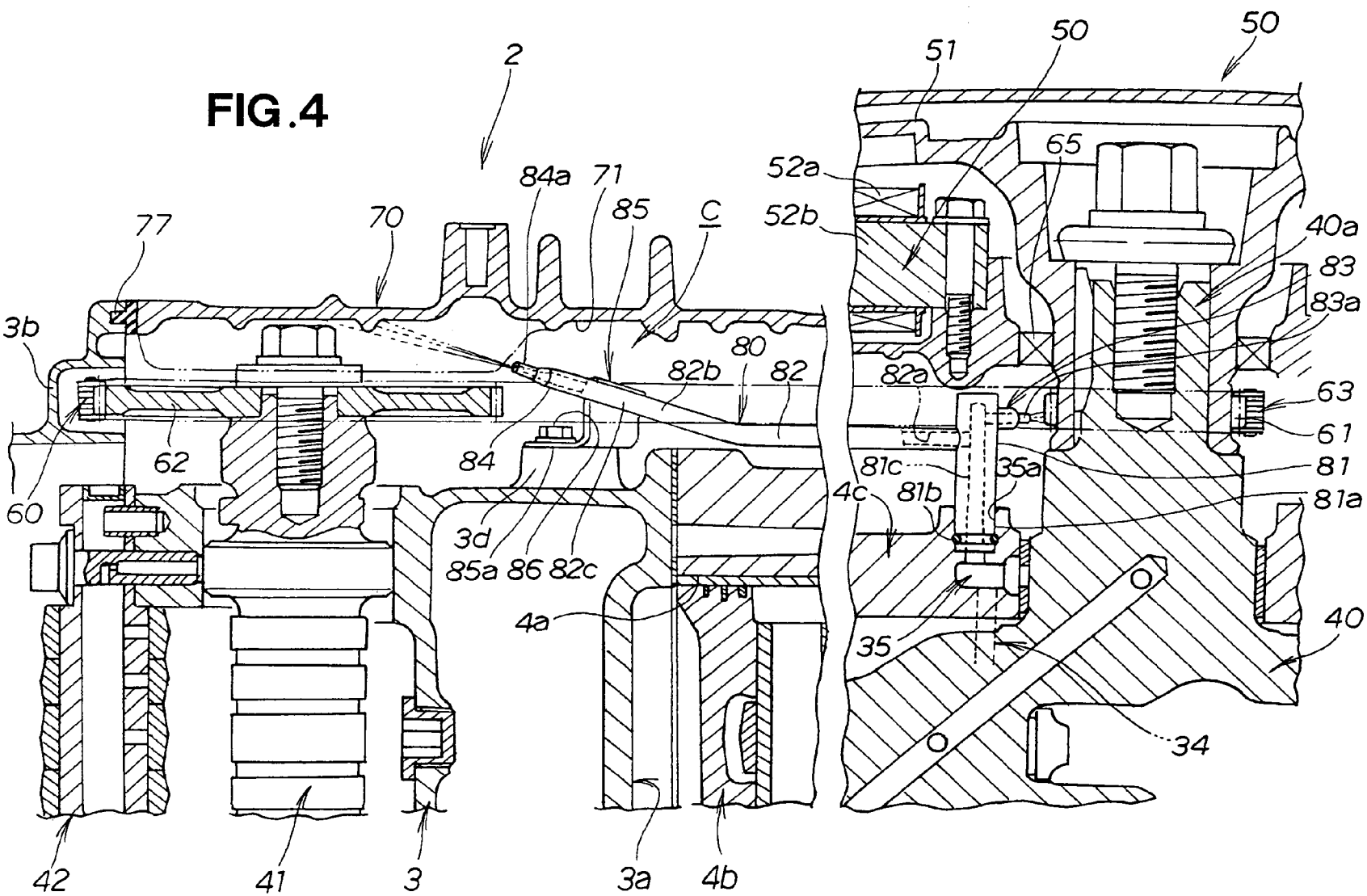
FIG. 4 is a further enlarged cross-sectional view of a portion of the engine shown in FIG. 3.

The main gallery 35 has a vertical hole 35*a* in the upper surface of the bearing 4*c* (journal portion) formed in the upper portion of the cylinder block 4, as shown in FIGS. 3 and 4. A lower portion 81*a* of a base tube portion 81 of a lubricating oil supply tube 80 is pressed into the vertical hole 35*a* by way of an O ring 81*b*. The base tube portion 81 protrudes upward to the vicinity of the drive sprocket 61.

The lubricating oil supply tube 80 has a long narrow extension tube 82 that extends rearward from the upper portion of the base tube portion 81. The base portion of the extension tube 82 is connected to the upper portion of the base tube portion 81. The base tube portion 81 has a channel 81*c* that is in communication with the main gallery 35. The channel 81*c* is in communication with a channel 82*a* inside the extension tube 82. As depicted the supply tube 80, including the base tube portion 81 and extension tube 82, is formed as a narrow, elongate, hollow member.

A first discharge unit 83 protrudes from the upper portion of the base tube portion 81. The first discharge unit 83 is disposed in an area adjacent to the drive sprocket 61 and is positioned in a location that does not interfere with the extension tube 82, i.e., on the side substantially opposite from the extension tube 82. The first discharge unit 83 is in communication with the channel 81*c*. The first discharge unit 83 is short in length and has a discharge port 83*a* provided with a narrowed aperture at the distal end.

The first discharge unit 83 is in close proximity to the drive sprocket 61 and is positioned inside the valve-operating chain 63, as shown in FIG. 5. The discharge port 83*a* of the first discharge unit 83 is disposed so as to be directed toward the vicinity of the meshing area between the drive sprocket 61 and valve-operating chain 63.

The extension tube 82 is positioned inside the recoil starter flange 53 and extends from the base tube portion 81 toward the driven sprocket 62 in the rear. The area between the intermediate area and the upstream area of the extension tube 82 is linear. The rear half portion 82*b* of the extension tube 82 is curved at a shallow angle toward the right-side surface of the outboard engine unit, as shown in FIG. 5, and is gradually curved and sloped upward, as shown in FIGS. 3 and 4.

The rear half portion 82*b* of the extension tube 82 has a second discharge unit 84 at the distal end of the rear half portion. The second discharge unit 84 has a discharge port 84*a* having a narrowed aperture at the distal end of the port. The discharge port 84*a* of the second discharge unit 84 is disposed so as to be directed toward the vicinity of the meshing area between the driven sprocket 62 and the valve-operating chain 63.

The extension tube 82 has a substantially Z-shaped stay 85 connected by welding or another method to the distal end portion 82*c* of the rear half portion 82*b*. The base portion 85*a* of the stay 85 is fixed using a bolt to a mounting boss portion 3*d* disposed in a protruding fashion on the surface of the cylinder head 3 of the engine block 2*a*. Therefore, the distal end portion 82*c* of the extension tube 82 is supported by the stay 85.

Figure 7:
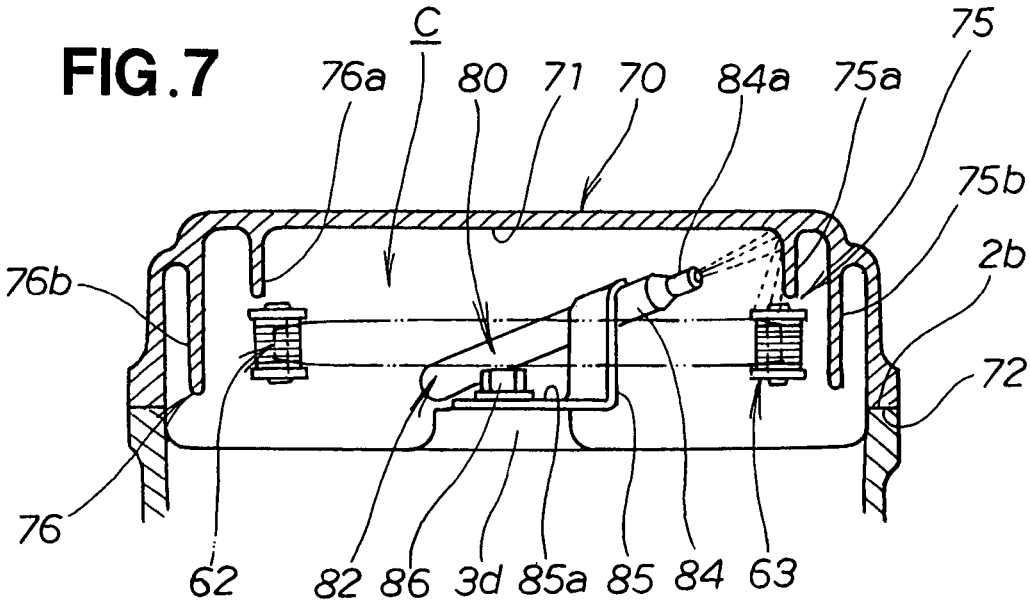
FIG. 7 is cross-sectional view showing the manner in which the lubricating oil is sprayed from the discharge port positioned in an area adjacent to the driven sprocket inside the chain drive mechanism housing.

The discharge ports 83*a* and 84*a* of the lubricating oil supply tube 80 are directed toward the meshing areas of the drive sprockets 61 and 62 and the valve-operating chain 63, as shown in FIGS. 5 and 7. In other words, the discharge ports 83*a* and 84*a* face the meshing start area between the valve-operating chain 63 and the driven and driven sprockets 61 and 62, and are configured so that lubricating oil is discharged and supplied as a jet flow to the meshing start area.

The drive sprocket 61 and driven sprocket 62 rotate in the clockwise direction in the manner indicated by the arrow, as shown in FIG. 5.

The lubricating oil is supplied by way of the base tube portion 81 of the lubricating oil supply tube 80 from the main gallery 35 to the first discharge unit 83, and to the second discharge unit 84 through the extension tube 82, as shown in FIG. 4. The lubricating oil is discharged from the discharge ports 83*a* and 84*a* toward the meshing start area between the valve-operating chain 63 and the drive and driven sprockets 61 and 62 as a jet flow.

The discharge port 84*a* is disposed facing the ceiling surface of the chain cover 70, and is set so that the discharged lubricating oil is dispersed and made to strike the ceiling surface of the chain cover 70 and then to disperse into the area in which the valve-operating chain 63 and the driven sprocket 62 mesh with each other.

The driven sprocket 62, which drives the camshaft 41, is given a larger diameter than the drive sprocket 61, and lubricating oil must therefore be reliably supplied with good efficiency to the driven sprocket 62 side.

In view of this configuration, a guide for the discharged lubricating oil is provided to the ceiling surface 71 facing above the driven sprocket 62 of the chain cover 70.

The ceiling surface 71 of the chain cover 70 is described above with reference to FIG. 6.

The ceiling surface (inner surface) 71 of the chain cover 70 has a peripheral portion 72 that is joined to the surrounding portion 2*b* (FIG. 5) that surrounds the chain drive mechanism 60 above the engine block 2*a* (FIG. 5). The peripheral portion 72 of the chain cover 70 is superimposed on the surrounding portion 2*b* of the engine block 2*a*, and the chain cover is joined to the engine block 2*a* by way of a seal 77 disposed on one side of the cylinder head cover 3*b* shown in FIG. 4.

A plurality of reinforcement ribs 73 that are connected to each other is disposed in a protruding fashion on the ceiling surface 71 of the chain cover 70. A through-hole 74 through which the upper portion 40*a* (FIG. 3) of the crankshaft 40 passes is formed in the ceiling surface 71.

Guide ribs 75 and 76 arrayed in a parallel fashion are disposed so as to protrude downward on the ceiling surface 71 of the driven sprocket 62 side that is opposite from the through-hole 74.

The guide ribs 75 on the meshing start area side are composed of guide ribs 75*a* and 75*b* that are set at a distance from each other in the inner and outer directions. The inner guide rib 75*a* has a considerably curved arcuate portion. The outer guide rib 75*b* has a gradual arcuate portion that has a greater diameter than that of the inner guide rib 75*a*.

The inner guide rib 75*a* and the outer guide rib 75*b* are connected by a connection portion 75*c*. The length of the inner guide rib 75*a* is substantially equal to ¼ of the circumference of the driven sprocket 62 from the area in which the driven sprocket 62 and the valve-operating chain 63 start to mesh with each other, as shown in FIG. 5.

The outer guide rib 75*b* is designed so that the lubricating oil is prevented from being dispersed outside of the outer guide rib 75*b* and so as to concentrate and fall downward with good efficiency into the chain drive mechanism housing compartment C when the lubricating oil discharged as a jet flow strikes the ceiling surface 71 and is dispersed.

Inner and outer guide ribs 76*a* and 76*b* on the side on which the valve-operating chain 63 is drawn out from the driven sprocket 62 (the side on which the meshing is released) prevents lubricating oil from dispersing in the drawing-out direction when the chain is drawn out. The inner and outer guide ribs 76*a* and 76*b* are designed so that the lubricating oil is prevented from being dispersed outside of the inner and outer guide ribs 76*a* and 76*b* and so as to concentrate and fall downward with good efficiency into the chain drive mechanism housing compartment C.

Figure 8:
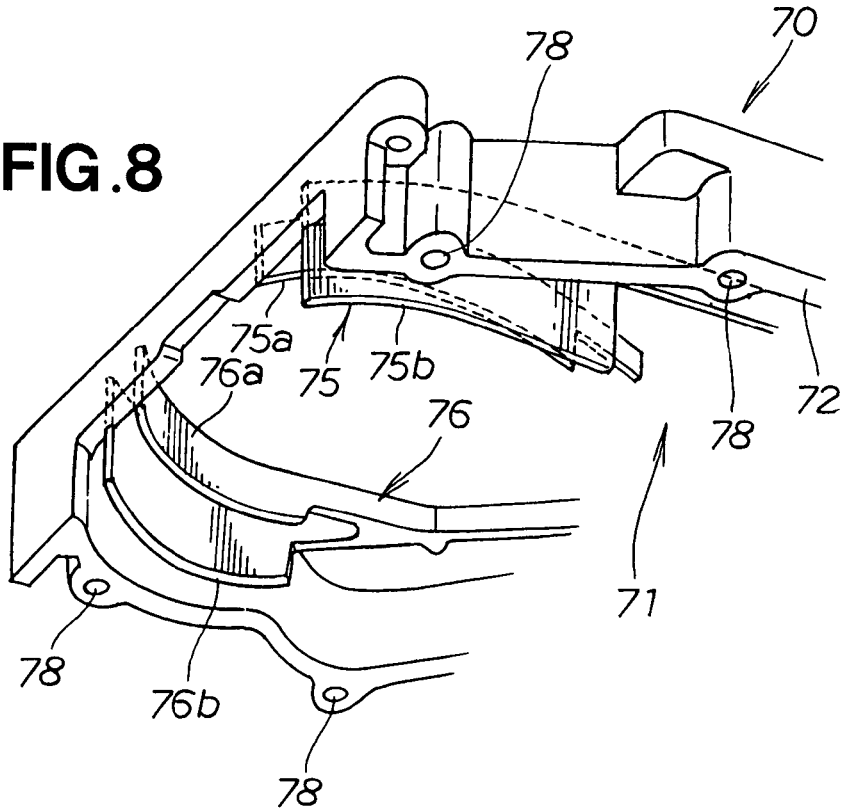
FIG. 8 is a perspective view showing a portion of the chain cover positioned on the side of the driven sprocket.

The discharge port 84*a* of the second discharge unit 84 is sloped toward the inner guide rib 75*a*, and the lubricating oil discharged as a jet flow is discharged in the area beginning from the meshing start area of the driven sprocket 62 to the meshing area, and toward the direction of the ceiling surface and the upper portion of the inner surface of the inner guide rib 75*a*, as shown in FIGS. 7 and 8.

Therefore, the lubricating oil is dispersed in the region above the meshing area that starts with the area in which the driven sprocket 62 and valve-operating chain 63 begin to mesh with each other. The lubricating oil thereafter strikes the inner guide rib 75*a* and the ceiling surface 71 and flows downward, and can effectively and reliably lubricate the sprocket and chain.

Figure 6:
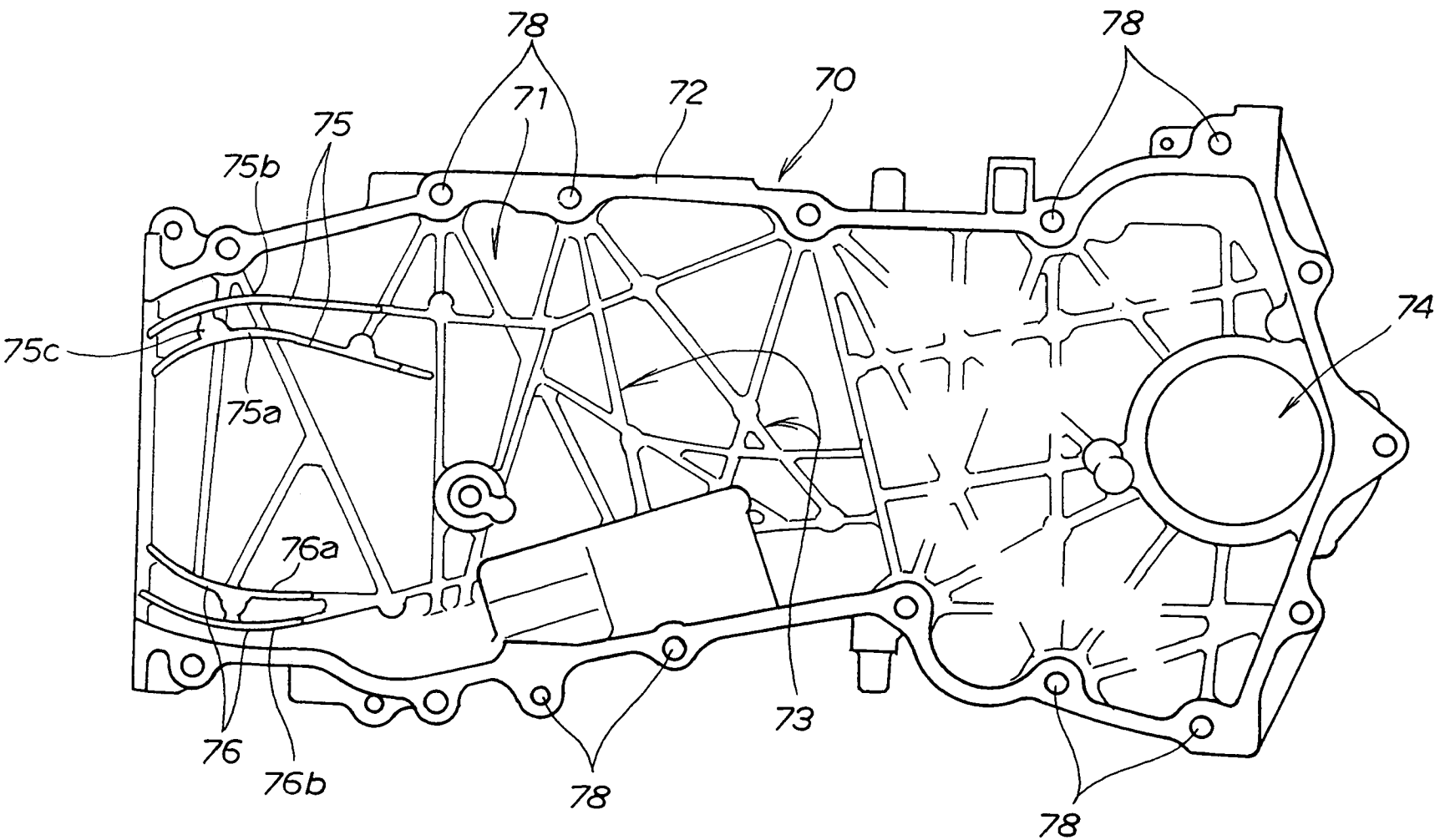
FIG. 6 is a diagram showing the ceiling surface of the chain cover.

As shown in FIGS. 6 and 8, a plurality of bolt holes 78 provided in the peripheral portion 72 of the chain cover 70 corresponds to the positions of a plurality of bolt holes 2*c* provided in the surrounding portion 2*b* of the engine block 2*a* shown in FIG. 5.

In the outboard engine unit 1 according to the present invention, a valve-operating chain 63 is disposed above the engine and is suspended across a drive sprocket 61 provided to the crankshaft and a driven sprocket 62 provided to a camshaft 41, and a lubricating oil supply tube 80 for supplying lubricating oil to the valve-operating chain 63 is connected to a main gallery 35 that is linked to a main oil channel 34 positioned in an area adjacent to the crankshaft 40. Therefore, a lubrication oil discharge port can be provided for lubricating the valve-operating chain 63 without being affected by the structure of the chain drive mechanism 60 of the camshaft 41 side. The structure is composed solely of a main gallery 35 and a lubricating oil supply tube 80 connected to the main gallery. In other words, the oil supply channel of the lubricating oil to the chain drive mechanism 60 is a single channel, the structure of the lubricating oil supply system is simplified, manufacturing is facilitated, and costs are reduced.

The lubricating oil supply tube 80 has a discharge port 84*a* directed toward the area above the chain compartment C. Lubricating oil is therefore scattered toward the ceiling surface 71 and allowed to flow downward, and the valve-operating chain 63 can be lubricated with good efficiency. The lubricating oil can be recovered in the chain compartment C, contributing to the effective use of lubricating oil.

The discharge ports 83*a* and 84*a* disposed at the two ends of the lubricating oil supply tube 80 are directed toward the meshing starting area between the valve-operating chain 63 and the drive and driven sprockets 61 and 62. The lubricating oil is therefore discharged with good efficiency to the meshing areas. Furthermore, since the inner guide rib 75*a* is downwardly suspended from the ceiling surface 71, as shown in FIG. 7, the lubricating oil can lubricate the sprockets 61 and 62 and the valve-operating chain 63 with greater efficiency.

Obviously, various minor changes and modifications of the present invention are possible in light of the above teaching. It is therefore to be understood that within the scope of the appended claims the invention may be practiced otherwise than as specifically described.

What is claimed is:

1. An outboard engine unit comprising:

a four-stroke vertical engine having a plurality of cylinders laid horizontally and a crankshaft disposed vertically;

a valve-operating chain disposed above the engine and trained around a drive sprocket and a driven sprocket, the drive sprocket being provided on the crankshaft, the driven sprocket being provided on a camshaft of the engine; and a supply tube for supplying lubricating oil to the valve-operating chain, the supply tube being configured to discharge lubricating oil onto the valve-operating chain and the drive and driven sprockets during operation of the engine, wherein the supply tube is connected to a main gallery that is linked to a main oil channel positioned in an area adjacent to the crankshaft.

2. The outboard engine unit according to claim 1, wherein the valve-operating chain is housed in a sealed chain compartment, and the supply tube has a discharge port oriented upwardly of the chain compartment such that oil discharged from the discharge port strikes a ceiling surface of the chain compartment and disperses into an area where said valve-operating chain and one of said drive and driven sprockets mesh with each other.

3. The outboard engine unit according to claim 2, wherein the supply tube has discharge ports disposed at two ends thereof and directed toward mesh start areas between the valve-operating chain and the drive sprocket and driven sprocket of the chain.

4. The outboard engine unit according to claim 1, wherein the valve-operating chain is housed in a chain compartment, and the supply tube is an elongate, hollow member which extends above the engine within the chain compartment.

5. The outboard engine unit according to claim 2, wherein the supply tube is an elongate, hollow member which extends within the sealed chain compartment.

6. The outboard engine unit according to claim 1, wherein the supply tube includes an elongate, hollow extension tube which extends substantially horizontally above the engine.

7. The outboard engine unit according to claim 2, wherein the supply tube includes an elongate, hollow extension tube which extends substantially horizontally within the sealed chain compartment.

8. The outboard engine unit according to claim 1, wherein the supply tube includes an extension tube extending substantially horizontally above the engine and a base tube connected between the extension tube and the main gallery.

9. The outboard engine unit according to claim 8, wherein the base tube extends substantially vertically, and the base and extension tubes are elongate hollow members.

10. The outboard engine unit according to claim 8, wherein the extension tube has a discharge port disposed at an end thereof extending away from the base tube and directed toward a mesh start area between the valve-operating chain and one of the drive sprocket and driven sprocket of the chain, and the supply tube includes another discharge port connected to the base tube and directed toward a mesh start area between the valve-operating chain and the other of the drive sprocket and driven sprocket of the chain.

11. The outboard engine unit according to claim 1, further including a stay which supports the supply tube above the engine.

12. The outboard engine unit according to claim 2, further including a stay which supports the supply tube within the chain compartment.

13. The outboard engine unit according to claim 1, wherein the supply tube is an elongate hollow member.

14. The outboard engine unit according to claim 1, further including a chain cover disposed above the valve-operating chain and drive and driven sprockets, and having reinforcing ribs thereon.

15. The outboard engine unit according to claim 1, wherein the valve-operating chain extends substantially horizontally between the drive and driven sprockets.

16. The outboard engine unit according to claim 6, wherein the supply tube extends substantially horizontally above the engine between said drive and driven sprockets.

17. The outboard engine unit according to claim 7, wherein the supply tube extends substantially horizontally above the engine between said drive and driven sprockets.

18. An outboard engine unit comprising:

a four-stroke vertical engine having a plurality of cylinders laid horizontally and a crankshaft disposed vertically;

a valve-operating chain disposed above the engine and trained around a drive sprocket and a driven sprocket, the drive sprocket being provided on the crankshaft, the driven sprocket being provided on a camshaft of the engine;

a supply tube for supplying lubricating oil to the valve-operating chain; and a chain cover disposed above the engine to define a sealed chain compartment housing the valve-operating chain, wherein the supply tube is connected to a main gallery that is linked to a main oil channel positioned in an area adjacent to the crankshaft, the chain cover has lubricating oil guide ribs formed thereon, the supply tube has a discharge port oriented upwardly in the chain compartment and discharges oil toward a ceiling surface of the chain cover and the guide ribs, the guide ribs guide the discharged oil toward mesh staff areas between the valve-operating chain and the drive sprocket and driven sprocket of the chain, and the chain cover has inner and outer guide ribs formed thereon, the inner guide ribs guide the discharged oil toward the mesh staff areas, and the outer guide ribs extend downwardly outside of the mesh start areas.

19. The outboard engine unit according to claim 18, wherein the outer guide rib prevents oil form being dispersed outside of the outer guide rib to concentrate and fall downward after the discharged oil strikes the ceiling surface and is dispersed.

* * * * *